US005445860A

United States Patent [19]

Bova

[11] Patent Number: 5,445,860

[45] Date of Patent: Aug. 29, 1995

[54] TUFTED PRODUCT HAVING AN IMPROVED BACKING

[75] Inventor: Patrick Bova, LaGrange, Ga.

[73] Assignee: GFF Holding Company, LaGrange, Ga.

[21] Appl. No.: 264,008

[22] Filed: Jun. 22, 1994

Related U.S. Application Data

[63] Continuation-in-part of Ser. No. 997,895, Dec. 29, 1992, abandoned.

[51] Int. Cl.[6] ..... B32B 3/02

[52] U.S. Cl. ..... 428/87; 156/72; 156/73.1; 156/82; 427/209; 427/223; 427/350; 427/359; 427/389.9; 427/398.2; 427/538; 428/85; 428/95; 428/96

[58] Field of Search ..... 428/94, 95, 96, 97, 428/196, 131, 137, 87, 85; 156/72, 73.1, 82; 427/389.9, 398.2, 209, 223, 350, 359, 538

[56] References Cited

U.S. PATENT DOCUMENTS

| | | | |
|---|---|---|---|
| 2,303,203 | 11/1942 | Faris et al. | 28/4 |
| 3,383,259 | 5/1968 | Cochran, II | 156/148 |
| 3,390,035 | 6/1968 | Sands | 156/72 |
| 3,519,526 | 7/1970 | Carey et al. | 161/67 |
| 3,533,893 | 10/1970 | Hartstein | 161/66 |
| 3,554,824 | 1/1971 | Callahan | 156/72 |
| 3,576,702 | 4/1971 | Matsui et al. | 161/65 |
| 3,583,346 | 6/1971 | Bloch et al. | 112/410 |
| 3,605,666 | 9/1971 | Kimmel et al. | 112/410 |
| 3,717,524 | 2/1973 | Culp et al. | 156/72 |
| 3,770,558 | 11/1973 | Stahl | 161/65 |
| 3,806,385 | 4/1974 | Terry | 156/72 |
| 3,847,719 | 11/1974 | Crowley | 161/65 |
| 3,887,738 | 6/1975 | Taft et al. | 428/95 |
| 3,922,454 | 11/1975 | Roecker | 428/95 |
| 4,000,707 | 1/1977 | Spirer | 112/410 |
| 4,009,310 | 2/1977 | Scobbo | 428/95 |
| 4,035,533 | 7/1977 | Chambley | 428/95 |
| 4,053,668 | 10/1977 | Kimmel et al. | 428/95 |
| 4,069,361 | 1/1978 | Kumer | 428/95 |
| 4,112,161 | 9/1978 | Sorrells | 428/97 |
| 4,305,986 | 12/1981 | Hartmann et al. | 428/95 |
| 4,308,304 | 12/1981 | Cochran, II | 428/95 |
| 4,355,592 | 10/1982 | Tajiri et al. | 112/410 |
| 4,412,877 | 11/1983 | Vosburgh | 156/72 |
| 4,426,415 | 1/1984 | Avery | 428/17 |
| 4,433,018 | 2/1984 | Tesch | 428/89 |
| 4,439,476 | 3/1984 | Guild | 428/96 |
| 4,439,575 | 4/1984 | Iwai et al. | 524/486 |
| 4,579,763 | 4/1986 | Mitman | 428/95 |
| 4,673,604 | 6/1987 | Frain, III et al. | 428/95 |
| 4,689,256 | 8/1987 | Slosberg et al. | 428/95 |
| 5,045,375 | 9/1991 | Davis et al. | 428/97 |
| 5,094,178 | 3/1992 | Watkins | 112/80.73 |
| 5,102,482 | 4/1992 | Rogers | 428/97 |
| 5,240,530 | 8/1993 | Fink | 156/94 |

*Primary Examiner*—James J. Bell
*Attorney, Agent, or Firm*—Troutman Sanders; Joel S. Goldman; Scott M. Frank

[57] ABSTRACT

A method for making tufted carpet, as well as the tufted carpet made by this method, are provided. Pile yarn fibers are tufted into a tufting backing, which is composed of a primary backing, a secondary backing, and an elastomer sandwiched between the primary and secondary backings. In another embodiment, the tufting backing comprises a primary backing and an elastomer applied to the primary backing, but does not include a secondary backing. In a preferred embodiment, the elastomer is applied to the primary backing in a non-contiguous form whereby voids are provided within the arrangement for the tufting backing to be tufted without the primary backing fibers being immobilized. After the pile yarn fibers are tufted into the tufting backing, the elastomer is heated such that it softens, allowing the elastomer to flow in and around the pile yarn fibers. The elastomer may then be cooled, thereby hardening the elastomer and bonding the pile yarn fibers to the primary backing.

23 Claims, 9 Drawing Sheets

TUFTED PRODUCT HAVING AN IMPROVED BACKING

CROSS-REFERENCE TO RELATED APPLICATION

This application is a Continuation-In-Part of Ser. No. 07/997,895 filed Dec. 29, 1992, now abandoned.

BACKGROUND OF THE INVENTION

1. Technical Field

This invention relates generally to tufted products. Particularly, this invention relates to tufted carpet having an improved tufting backing and a method of making such tufted carpet and tufting backing.

2. Description of the Prior Art

Many types of carpet, as well as other fabrics, are prepared by the process of "tufting", whereby fibers, such as pile yarn fibers, are forced through a backing material. For example, with respect to tufted carpet, lengths of pile yarn fiber may be forced through the backing so that both ends of the pile yarn fiber extend on one side of the backing. A plurality of pile yarn fibers are tufted into the backing so as to create the carpet.

A current process for making tufted carpet is depicted in FIG. 2, and includes several steps in addition to the tufting of the pile yarn fibers. The process of FIG. 2 results in the tufted carpet depicted in FIG. 1. Referring to FIGS. 1 and 2, pile yarn fibers 101 are first tufted into a primary backing 102, which may comprise a woven or non-woven polypropylene sheet, in step 201. After the fibers 101 have been tufted into the primary backing 102, the fibers 101 may be dyed a specific color, and the carpet is then dried, as shown in step 202. In step 203, a layer of latex 103 is applied to the back of the carpet (e.g., the side of the primary backing opposite the side containing the extended ends of the pile yarn fibers), and a secondary backing 104, either woven or non-woven, is applied onto the latex. Finally, in step 204, the carpet is cooled and rolled up.

In the prior art carpet shown in FIG. 1, the layer of latex 103 bonds to the pile yarn fibers 101, and serves to hold the fibers 101 in place. Latex 103 commonly may consist of many compounds, including a phenylcyclohexene compound, which is used because of its ability to bond to the fibers as it dries. Unfortunately, phenylcyclohexene has also recently been found by some people to be carcinogenous (cancer-causing), making it unsuitable for use with carpet which comes into contact with humans.

Additionally, because of the numerous steps currently utilized to make tufted carpet, prior art methods of making tufted carpet is relatively expensive. Complex machinery is needed to perform the necessary steps, and a significant amount of material, time and labor is needed to make the carpet. Furthermore, given the characteristics of phenylcyclohexene, the bonding strength of the latex 103 with the pile yarn fibers 101 is limited, leading to the potential for pile yarn fibers 101 to be pulled out of the carpet.

These and other shortcomings of prior art tufted carpet and the method for making the same is effectively overcome by the teachings of the present invention, as described in further detail below.

SUMMARY OF THE INVENTION

In accordance with the teachings of the present invention, a method for making tufted carpet having an improved backing, as well as the tufted carpet made by this method, are provided. In one embodiment, pile yarn fibers are tufted into a tufting backing, which is composed of a primary backing, a secondary backing, and an elastomer sandwiched between the primary and secondary backings. In another embodiment, the tufting backing comprises a primary backing and an elastomer adhered to the primary backing, but does not include a secondary backing.

For both of the above-described embodiments, the elastomer may comprise a thermoplastic, such as ethylene/vinyl acetate (EVA). After the pile yarn fibers are tufted into the tufting backing, the carpet is dyed and heated to dry the dye as well as to soften the thermoplastic elastomer, allowing the thermoplastic elastomer to flow in and around the pile yarn fibers. The thermoplastic elastomer may then be cooled, thereby bonding the pile yarn fibers to the tufting backing.

For both embodiments, the elastomer may be applied to the primary backing in two forms. The first form, referred to as the solid sheet form, continuously covers all or a portion of the primary backing. The second form, referred to as the non-contiguous form, creates one or more voids on the primary backing.

By applying the elastomer to the primary backing in the non-contiguous form, the retained strength of the tufting backing is improved during and subsequent to the tufting process. The improved strength results because, unlike with the solid sheet form of elastomer, the primary backing fibers are not immobilized as the tufting needles force the pile yarn through the tufting backing. One method of applying the elastomer to the primary backing in the non-contiguous form includes heating the elastomer until it melts, pumping the elastomer onto the primary backing through a die having small orifices, and cooling the elastomer with one or more chilled rollers.

To improve the bonding of the elastomer to the primary backing, the primary backing may be treated with a corona discharge or gas flame. Further, suctioning the elastomer to the primary backing with a vacuum may also be used to improve the bonding.

DETAILED DESCRIPTION OF THE INVENTION

Figure 3A:
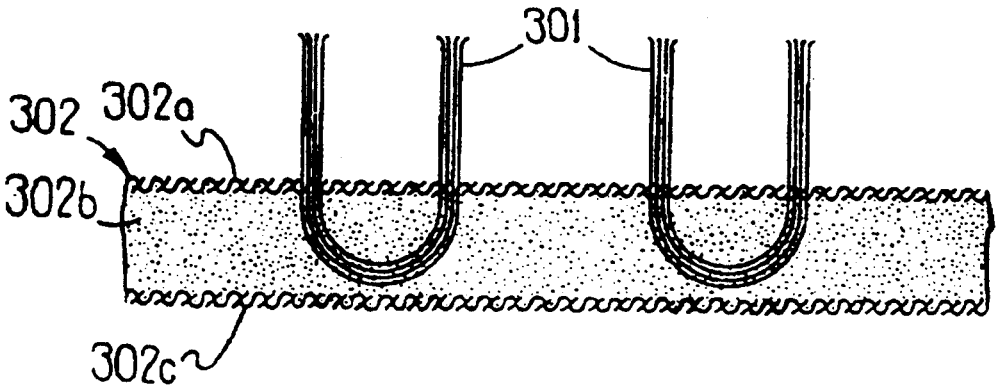
FIG. 3A depicts a side-view of tufted carpet according to a preferred embodiment of the present invention.

Referring to FIG. 3A, a side-view of tufted carpet is depicted according to a preferred embodiment of the present invention. Particularly, a tufting backing 302 is provided through which one or more pile yarn fibers 301 are tufted. In a preferred embodiment, pile yarn fibers 301 may comprise fibers made of nylon or polypropylene, commonly available from many sources, such as Shaw Industries, Beauliew Inc., Hercules, etc., and sold under various brand names. 0f course, other equivalent pile yarn fibers 301, or other fibers, may be used as well.

In one embodiment, tufting backing 302 may comprise a primary backing 302*a*, a secondary backing 302*c*, and an elastomer 302*b* sandwiched between primary backing 302*a* and secondary backing 302*c*. Primary backing 302*a* and secondary backing 302*c* may be formed of either woven or non-woven fibers, and may comprise a polypropylene sheet in a preferred embodiment. For example, primary backing 302*a* and secondary backing 302*c* may comprise woven polypropylene having a weight of 3.5 ounces/yard$^2$, or non-woven polypropylene having a weight of 3 ounces/yard$^2$. Such backing is available from General. Fibers and Fabrics, the intended assignee of the present invention, and sold under the brand name "Supertuft" (a trademark of General Fibers and Fabrics). Of course, any other equivalent material may be used as well, such as jute, etc.

Figure 3B:
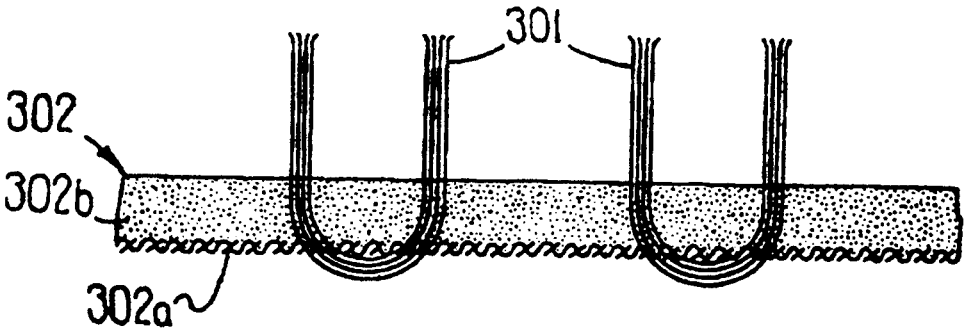
FIG. 3B depicts a side-view of tufted carpet according to another embodiment of the present invention.

In another embodiment, tufting backing 302 may be made without secondary backing 302*c*, as depicted in FIG. 3B. In this case, only primary backing 302*a* and elastomer 302*b* are present, and pile yarn fibers 301 are therefore only tufted through these two layers. In this configuration tufting backing 302 operates in a similar manner as when a secondary backing 302*c* is also present, except that less material is necessary.

tufting backing 302 may be made in one of a variety of commonly known ways. For example, in a preferred embodiment, tufting backing 302 may be made by utilizing turnkey equipment available from several sources. Such equipment is available from such well-known manufacturers as Bouligny of Charlotte, N.C.; Meccaniche Moderne of Busto Arsizio, Italy; Reifenhausen of Troisdorf, Germany; and Lurgi of Frankfurt, Germany.

Those of ordinary skill in the art will readily recognize that non-turnkey equipment may be readily implemented by utilizing various pieces of equipment available from these and other manufacturers. It will be readily recognized that there are numerous known methods to prepare tufting backing 302, and the present invention shall not be deemed to be limited to any one method.

Figure 5:
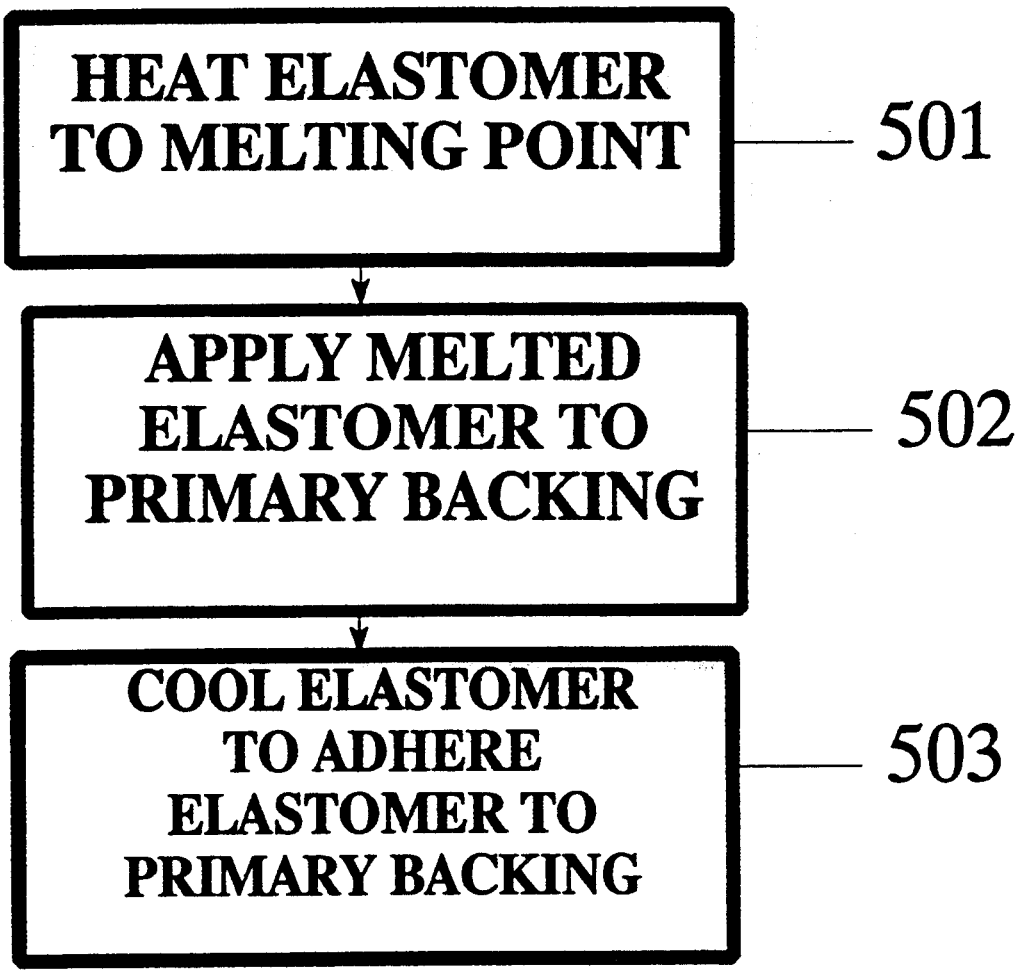
FIG. 5 depicts a process diagram for making the tufting backing depicted in FIGS. 3A or 3B, according to a preferred embodiment of the present invention.

FIG. 5 shows the various steps which may be taken in order to make tufting backing 302. First, in step 501, in order to adhere elastomer 302*b* onto primary backing 302*a*, elastomer 302*b* may be heated to a temperature so as to completely melt elastomer 302*b*. For example, in a preferred embodiment, elastomer 302*b* may be heated to a temperature of approximately 177–203 degrees C. (350–400 degrees F.). Thereafter, the melted elastomer 302*b* is applied to primary backing 302*a* in step 502, elastomer 302*b* is cooled in step 503, and elastomer 302*b* thereby adheres to primary backing 302*a*. In one embodiment, the cooling step 503 may be performed by exposing elastomer 302*b* to the surrounding room temperature environment.

FIGS. 6A, 6B, 6C and 6D illustrate forms in which the elastomer 302*b* may be applied to the primary backing 302*a*. The two forms are solid sheet and non-contiguous (fully or partially).

Figure 6A:
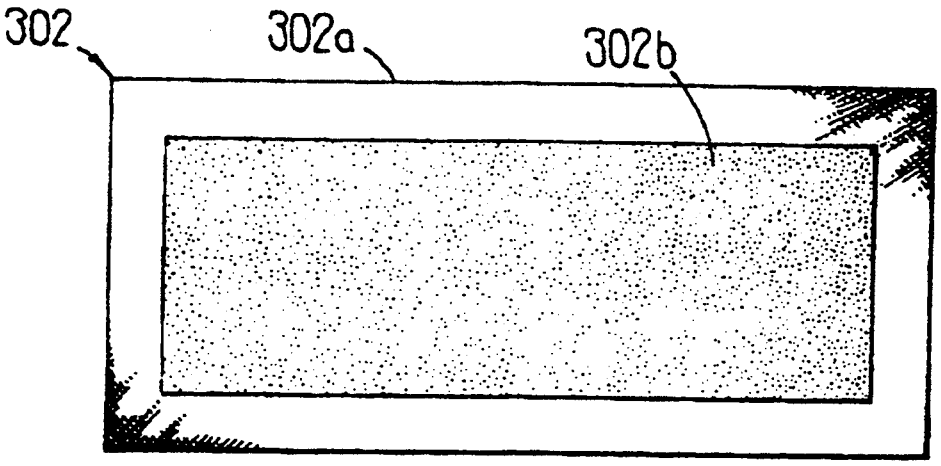
FIG. 6A depicts a top-view of tufting backing with a solid sheet form of elastomer according to a preferred embodiment of the present invention.

FIG. 6A depicts elastomer 302*b* applied to the primary backing 302*a* in the solid sheet form. The solid sheet form of the elastomer 302*b* is a continuous distribution of elastomer 302*b* which covers all or a portion of the primary backing 302*a*. Further, the solid sheet form of elastomer 302*b* does not leave any voids on the surface of the primary backing 302*a* portion covered by the solid sheet form of elastomer 302*b*.

Figure 6B:
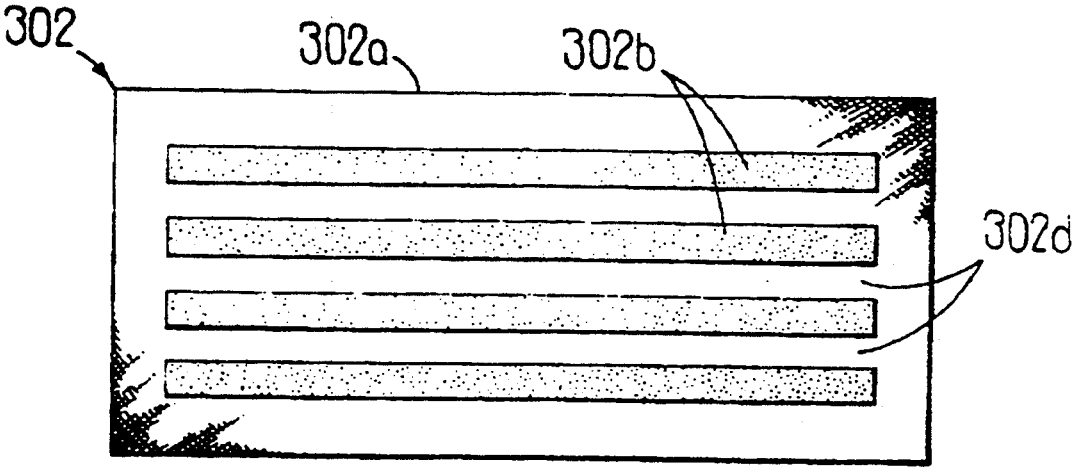
FIG 6B depicts a top-view of tufting backing with a non-contiguous form of elastomer according to a preferred embodiment of the present invention.
Figure 6C:
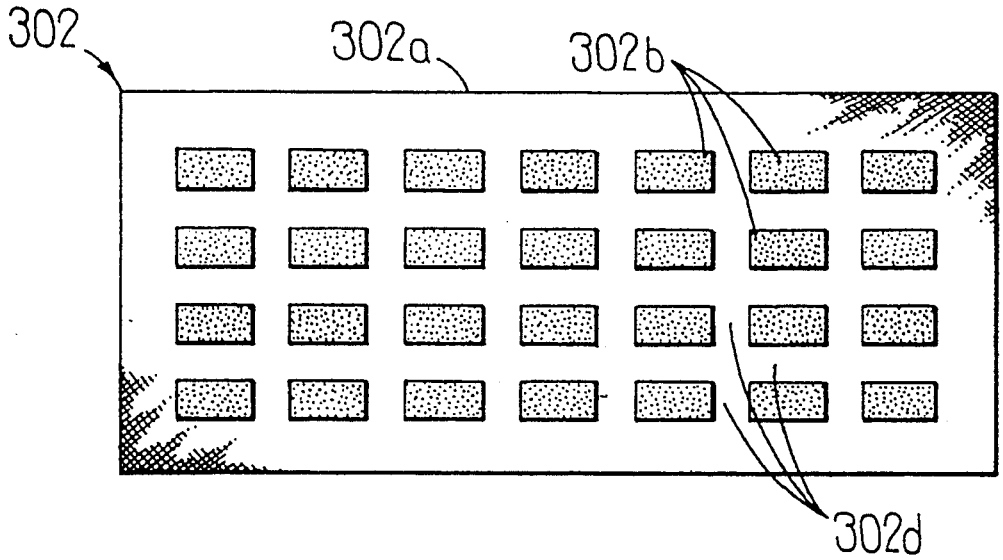
FIG. 6C depicts a top-view of tufting backing with a non-contiguous form of elastomer according to another embodiment of the present invention.
Figure 6D:
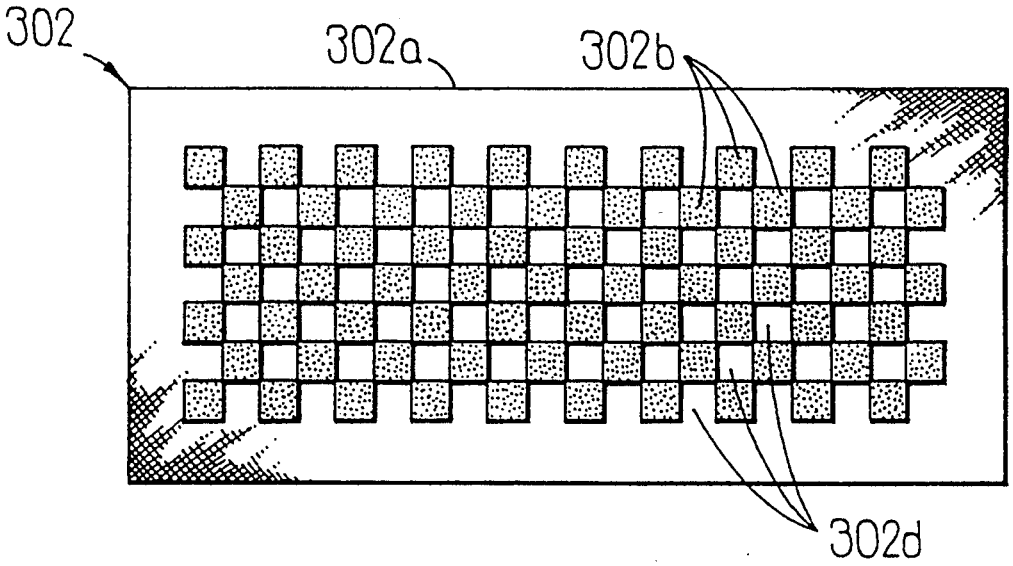
FIG. 6D depicts a top-view of tufting backing with a non-contiguous form of elastomer according to yet another embodiment of the present invention.

FIGS. 6B, 6C and 6D show elastomer 302*b* applied to the primary backing 302*a* in a non-contiguous form whereby voids 302*d* are provided on the surface of the primary backing 302*a*. Voids 302*d* may be created on the surface of the primary backing 302*a* by applying the elastomer in portions having different shapes and sizes. Specifically, FIG. 6B illustrates the elastomer 302*b* applied in strands, also referred to as ribs, and FIG. 6C depicts the elastomer 302*b* applied in dashes, where the voids 302*c* are created between the strands and dashes, respectively. FIGS. 6B and 6C are examples of fully non-contiguous forms of elastomer because the strands and dashes do not touch in their respective illustrated formations.

FIG. 6D illustrates the elastomer 302*b* applied to the primary backing 302*a* in a partially non-contiguous form, where the voids 302*d* are created by applying the elastomer in dashes in a checkerboard format such that the corners of the dashes touch but the-side edges of the dashes do not touch. As one of ordinary skill in the art will readily recognize, the elastomer 302*b* may be applied to the primary backing 302 in the non-contiguous form in many other shapes, such as dots, where the strands, dashes and dots may take almost any geometric shape including but not limited to a square, rectangle, triangle, and circle. A void 302*d* in the non-contiguous sheet form may also take many geometric shapes including but not limited to a square, rectangle, triangle, and circle. Finally, one of ordinary skill in the art will also readily understand that many other formats, in addition to the checkerboard format, may be utilized.

The solid sheet form of elastomer 302*b* may be applied to the primary backing 302*a* by any means that will allow a continuous distribution of the elastomer 302*b* to cover all or a portion of the primary backing 302*a*. One such means includes sewing the solid sheet form of elastomer 302*b* to the primary backing 302*a*.

Another such means includes heating, extruding, and cooling the solid sheet form of elastomer 302*b*, which is preferably of a high viscosity and a low melt index, to the primary backing 302*a*.

On the other hand, the non-contiguous form of elastomer 302*b* is preferably applied to the primary backing 302*a* by heating the elastomer 302*b*, pumping the elastomer 302*b* onto the primary backing 302*a* through a die with small orifices, and cooling the elastomer 302*b*. The elastomer 302*b* used for this embodiment is preferably of a low viscosity and high melt index, as compared to the solid sheet elastomer 302*b*. Therefore, the elastomer 302*b* may be melted at a temperature between 150 degrees Fahrenheit and 300 degrees Fahrenheit.

Since the elastomer 302*b* in the non-contiguous form may be of a low viscosity, the elastomer 302*b* may be pumped onto the primary backing 302*a*. As described above, this technique differs from the one used for the solid sheet form of elastomer 302*b* which, due to its high viscosity, is preferably extruded. As one of ordinary skill in the art will readily recognize, pumping of the elastomer 302*b*, as opposed to extruding, is preferred in a manufacturing environment due to the lower cost realized by using this technique.

As illustrated in FIG. 3B, the non-contiguous form of elastomer 302*b* is preferably applied to the primary backing 302*a* on the side having the face 301*a* of the pile yarn fiber 301. One reason for this preferred placement of the elastomer 302*b* is that the soft elastomer 302*b* will be prevented from touching and possibly sticking to support rollers, which support the tufting backing 302 after the elastomer 302*b* is applied to the primary backing 302*a*.

Figure 7A:
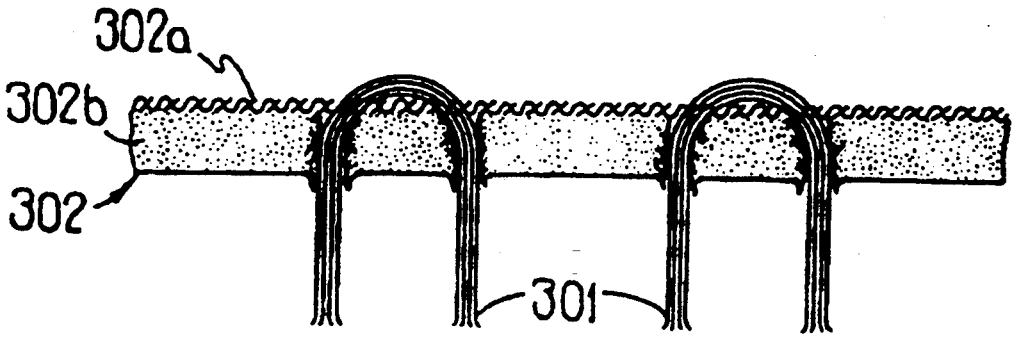
FIG. 7A depicts a side-view of tufted carpet with a solid sheet form of elastomer prior to melting the elastomer.

Another reason the non-contiguous form of elastomer 302*b* may be preferred over the solid sheet form of elastomer 302*b* is due to the fact that the tufting backing 302 using the non-contiguous form of elastomer retains more strength subsequent to the pile yarn fibers 301 being tufted through the tufting backing 302 as described in more detail below. the tufting backing 302 as described in more detail below. The reason for the lessened strength of the tufting backing 302 when using the solid sheet form of elastomer 302*b* is illustrated in FIG. 7A. Because the pile yarn fibers 301 are tufted through the elastomer 302*b* and the primary backing 302*a*, in which the elastomer 302*b* is bonded, the fibers of the primary backing 302*a* and the elastomer 302*b* tear or deteriorate when the tufting needles hit the tufting backing 302. This results because typically between 32 and 100 tufting needles penetrate a square inch of the tufting backing 302 during the tufting process.

Figure 7B:
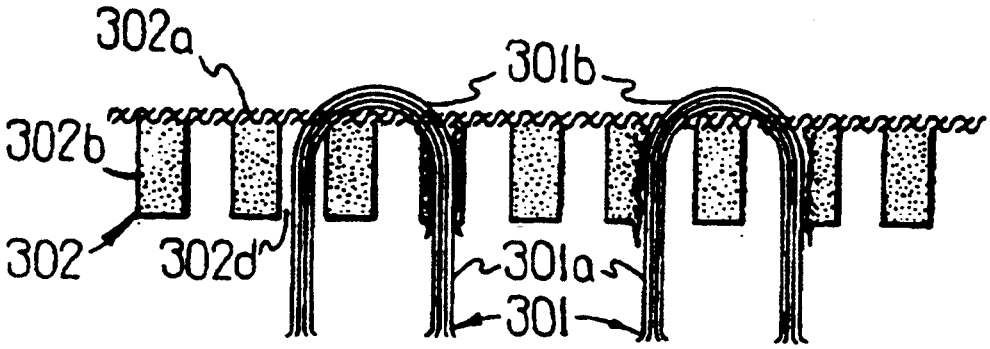
FIG. 7B depicts a side-view of tufted carpet with a non-contiguous form of elastomer prior to melting the elastomer.

On the other hand, as shown in FIG. 7B, when utilizing the non-contiguous form of elastomer 302*b*, the pile yarn fibers 301 may be tufted through voids created by the elastomer 302*b* (e.g., between the strands, dots, and dashes) or through side portions of the elastomer 302*b*, such that the fibers of the primary backing 302*a* may shift within a void 302*d* without tearing. The fibers of the primary backing 302 may shift because they are not completely immobilized by the elastomer 302*b* due to the void 302*d*. Therefore, when pile yarn fibers are tufted through the tufting backing 302, unlike with the solid sheet form of elastomer 302*b*, the primary backing fibers are less apt to tear or deteriorate resulting in the tufting backing 302 retaining much more strength after tufting.

Figure 7C:
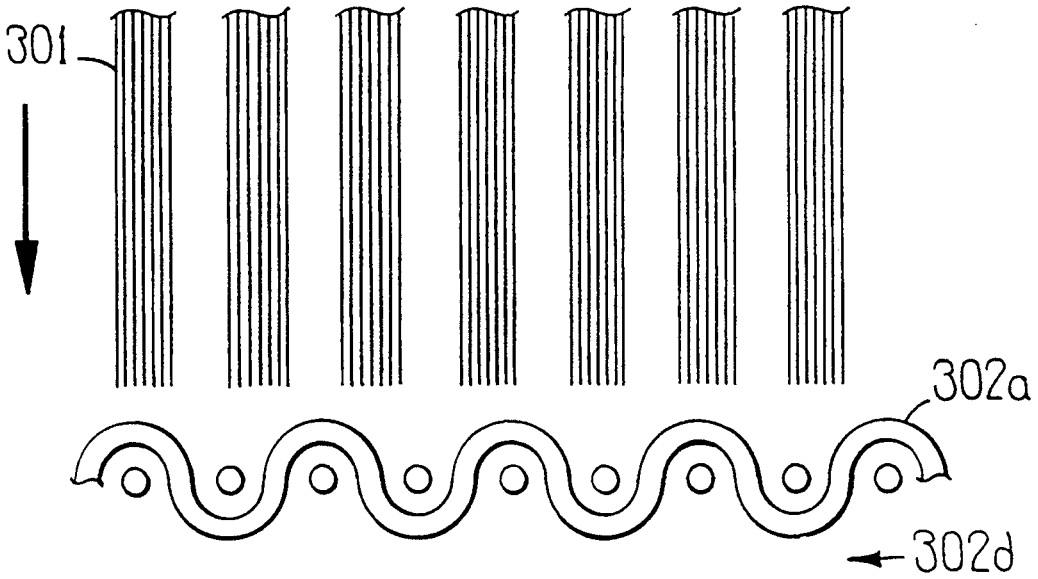
FIG. 7C depicts an isolated exploded perspective of a void created on a primary backing prior to the tufting of pile yarn fibers.
Figure 7D:
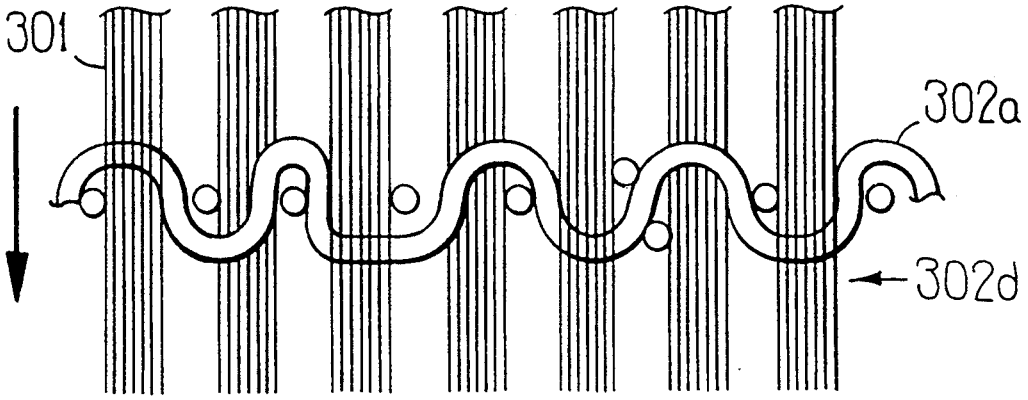
FIG. 7D depicts an isolated exploded perspective of a void created on a primary backing subsequent to the tufting of pile yarn fibers.

FIGS. 7C and 7D illustrate the shifting of the fibers of the primary backing 302*a* that takes place when pile yarn fibers 301 are tufted through a void 302*d* created on the surface of the primary backing 302*a*. FIG. 7C shows the normal position of the fibers of the primary backing 302*a* located within a void,302*d* prior to being tufted by pile yarn fibers 301. Subsequent to the tufting, FIG. 7D depicts the shifted position of the fibers of the primary backing 302*a* within the void 302*d*, where the amount and direction of the shifting of the fibers of the primary backing 302*a* within the void 302*d* is predominately dependent on the size of the void 302*a* and the location of the tufted pile yarn fibers 301.

In fact, it has been found that a tufting backing 302 using the solid sheet form of elastomer 302*b* having a tensile strength of one hundred pounds per inch before tufting is typically reduced to approximately five pounds per inch, which is equal to a 40 pound basis weight paper, after tufting. On the other hand, when utilizing the non-contiguous form of elastomer 302*b*, the tensile strength is typically only reduced to approximately sixty pounds per inch. Therefore, the non-contiguous form of elastomer 302*b* may be further preferred in a manufacturing environment because of the enhanced retained strength of the resulting tufting backing 302 in addition to its lower cost to apply the elastomer 302*b* to the primary backing 302*a*.

Figure 1:
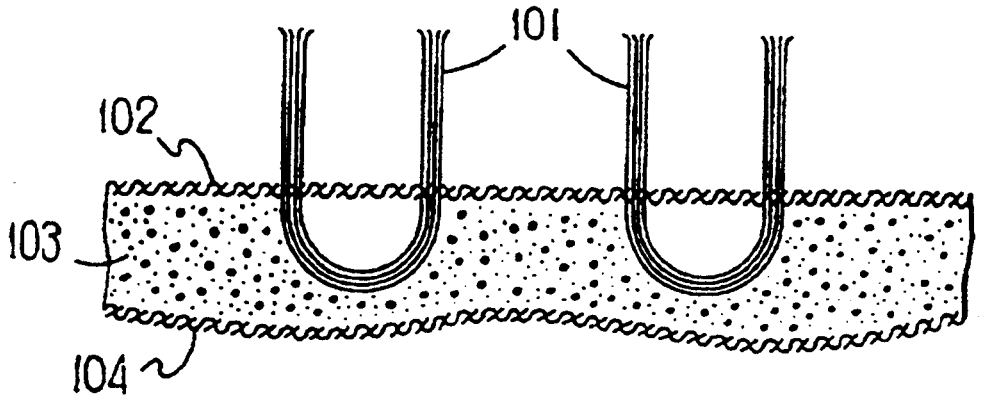
PRIOR ART FIG 1
FIG. 1 depicts a side-view of tufted carpet known in the prior art.
Figure 2:
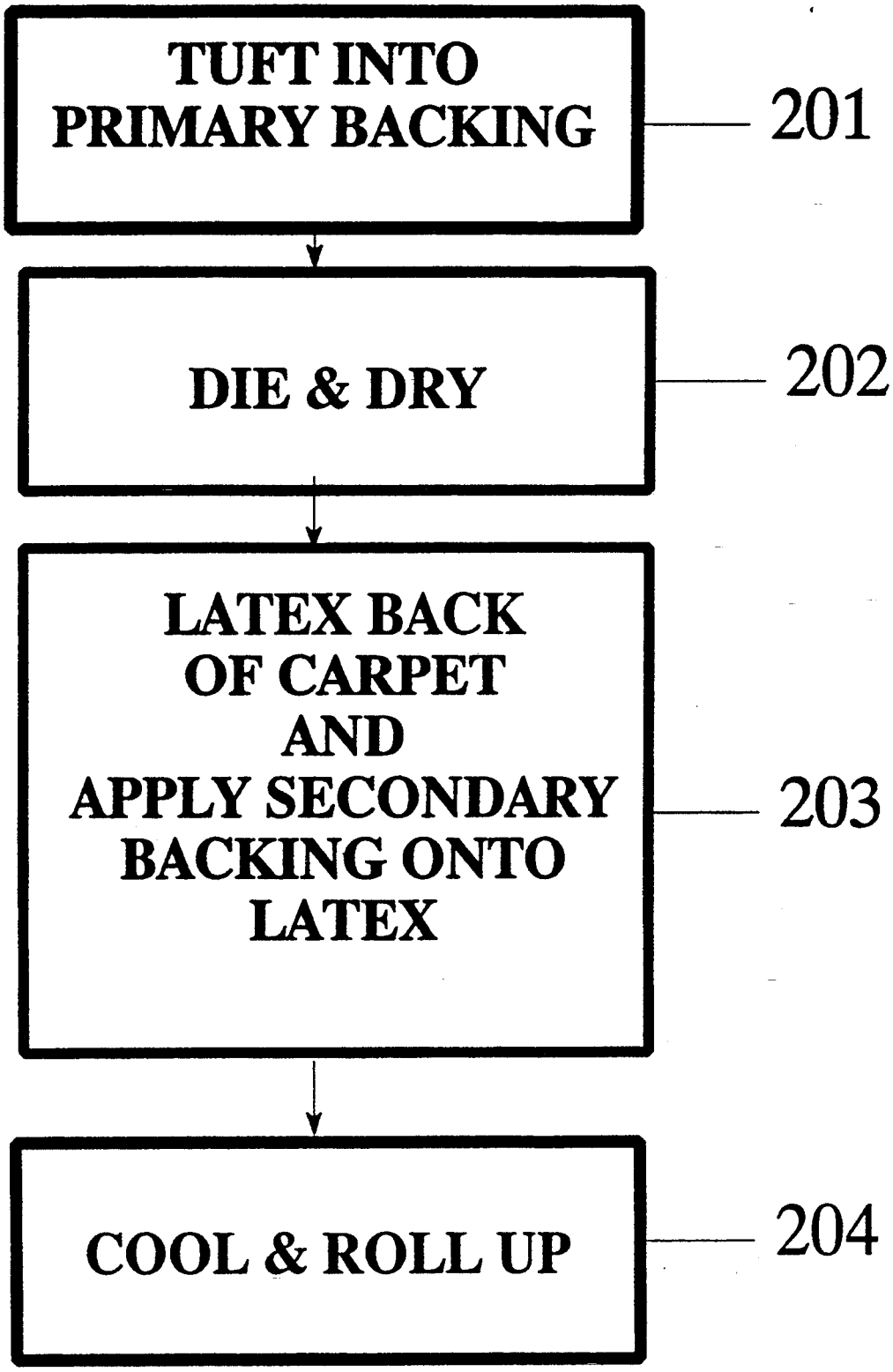
FIG. 2 (PRIOR ART)
FIG. 2 depicts a prior art process diagram for making the prior art tufted carpet depicted in FIG. 1.

Additionally, use of the non-contiguous form of elastomer 302*b* provides for a lighter tufting backing 302 and, thus, a lighter final carpet, as compared to the solid sheet form of elastomer 302*b* as well as prior art carpet using the secondary backing and latex as described in FIGS. 1 and 2. Therefore, the carpet utilizing the non-contiguous form of elastomer 302*b* will typically cost less to ship and be easier to install.

As described above, the non-contiguous form of elastomer 302*b* is initially prepared for application to the primary backing by melting the elastomer 302*b*. Since the elastomer is of a low viscosity, it may be melted at a temperature between 150 degrees Fahrenheit and 300 degrees Fahrenheit.

A preferred means of pumping the melted non-contiguous form of elastomer 302*b* onto the primary backing includes the use of a metering pump coupled to a die having small orifices. A preferred metering pump is the FSP-300-225-X produced by the Normag Corp. Division of the Dynisco Co. of Hickory, N.C. Equivalent metering pumps may also be used, including those manufactured by the Zenith Pumps Division of the Parker Hannifin Corp. of Sanford, N.C.

The die is preferably made of stainless steel. The size of the orifices are preferably between 0.020 inches and 0.0625 inches in diameter with 0.039 inches currently known to be the optimum diameter. The number of orifices per inch is preferably six to sixteen orifices with twelve currently known to be the optimum number. As one skilled in the art will appreciate, the die could be made of any equivalent material, such as tool steel, the orifices could be of almost any size, and the number of orifices per inch could be less than six or many more than twelve.

The non-contiguous form of elastomer 302*b* may be cooled by several means. These means include cooling the elastomer 302*b* at room temperature or cooling the elastomer 302*b* with one or more chilled rollers. When using the chilled rollers, the primary backing 302*a* with the elastomer 302*b* applied to it is preferably passed over the chilled rollers and the cooling temperature is preferably between 40 degrees Fahrenheit and 50 degrees Fahrenheit. Though fewer or more may be used, four chilled rollers have been found to optimize the cooling process. As one of ordinary skill in the art will readily recognize, other cooling systems may be used such as a ventilation system.

In order to improve the bonding of the elastomer 302*b* with primary backing comprising a 302*a* polypropylene (woven or non-woven) sheet, the primary-backing 302*a* may be treated with one of several means. Means of treating the primary backing 302*a* include applying a corona discharge or gas flame treatment to the primary backing 302*a*. Since polypropylene may contain a variety of crystallinity levels the amount of treating may vary for different polypropylene primary backings 302*a*. As one of ordinary skill in the art will readily appreciate, other equivalent means may also be utilized to treat the primary backing 302*a*.

Another method of improving the bonding of elastomer 302*b*, particularly the non-contiguous form, onto a woven primary backing 302*a* includes the use of a vacuum to suction the elastomer 302*b* into the primary backing 302*a*. This method improves the impinging of the elastomer 302*b* into the interstices of the woven fibers of the primary backing 302*a*. The vacuum may be created by any suitable vacuum or blower. A positive displacement blower of the size 12×12 HD, which is manufactured by BJI Inc. of Atlanta, Ga. or W. W. Meyer & Sons of Skokie, Ill., has been found to generate adequate vacuum pressure. Moreover, a pressure blower, such as the G3582-100 manufactured by N.Y. Blower Co. of LaPorte, Ind. which runs at approximately 3500 r.p.m. has been found to perform adequately. Further, as one of ordinary skill in the art will readily appreciate, many other suitable equivalent vacuum type devices may be used.

The vacuum is preferably positioned below the orifices of the die and in close proximity to the primary backing 302*a* on the side of the primary backing 302*a* opposite the side of the pump. In a preferred embodiment, a vacuum of eight to twenty inches of water column is used. The number of inches of water column depends on the tightness of the weaving in the woven primary backing 302*a* where more inches of water column are used for tighter, more close-knit weaves.

Whether using the solid sheet or non-contiguous form of elastomer 302*b*, a lubricant may also be placed on the side of the primary backing 302*a* opposite the side the elastomer 302*b* is applied. This lubricant facilitates the needles ability to tuft through the tufting backing 302 during the tufting process as described in more detail below. Moreover, the lubricant also decreases the friction created when the needles tuft the pile yarn fibers 301 through the tufting backing 302 resulting in less heat coming in contact with the pile yarn fibers 301.

Importantly, though the carpet industry currently primarily uses woven polypropylene primary backing 302*a*, where the fibers of the primary backing 302*a* are woven, the non-contiguous form of elastomer may be used with almost any type of primary backing 302*a*. These other types of primary backings 302*a* include, but are not limited to, cotton and jute materials and non-woven primary backings 302*a*.

Whether using the solid sheet or the non-contiguous form of elastomer 302*b*, in one embodiment, the elastomer 302*b* may comprise a thermoplastic elastomer. This type of elastomer may generally be thought of as a thermoplastic which may be melted many times without substantially changing its characteristics.

The thermoplastic elastomer may comprise ethylene/vinyl acetate, which is a known thermoplastic. For example, the thermoplastic elastomer 302*b* may comprise ethylene/vinyl acetate (EVA) available from a wide variety of sources, such as DuPont of Wilmington, Del., under the brand name of ELVAX (a trademark of DuPont).

In a preferred embodiment, the thermoplastic elastomer 302*b* may comprise ELVAX sold under the part number 220W, which has a melt index of 400, a percentage of vinyl acetate of 33%. Another suitable ELVAX is sold under the part number 340W, which has a melt index of 150, a percentage of vinyl acetate of 28%. It will be readily understood by one of ordinary skill in the art that the particular type of thermoplastic chosen for elastomer 302*b* is highly dependent upon the desired characteristics of the thermoplastic, and that thermoplastics are produced in many different types and with many different characteristics.

A distinct advantage which ethylene/vinyl acetate has over latex, which contains phenylcyclohexene, is that ethylene/vinyl acetate is considered to be non-carcinogenous (non-cancer-causing), while the same is not necessarily true for latex which contains phenylcyclohexene. Therefore, ethylene/vinyl acetate can more readily be used in carpet which will come into contact with humans or animals, while phenylcyclohexene cannot be used in this environment without posing a possible health hazard.

In addition to ethylene/vinyl acetate, other types of thermoplastics may be used for elastomer 302*b*. For example, elastomer 302*b* may comprise ethylene/-methyl acrylate (EMA) available from many sources, such as Exxon Chemical of Houston, Tex. under the brand name of Optima (a trademark of Exxon). Another type of elastomer 302*b* which may be used is ethylene/ethyl acetate (EEA) available from many sources, such as Union Carbide.

When using the non-contiguous form of elastomer 302*b*, a mixture containing between 50% and 80% EVA, between 10% and 30% EMA, and a tactifier is preferred depending on the pile yarn fibers 301 used. The EVA preferably contains between 30% to 40% vinyl acetate, the EMA preferably contains between 20% and 30% methyl acrylate, and the tactifier is preferably piccopale, though other tactifiers such as amorphous polypropylene may be used. The type of surface found on the primary backing 302*a* dictates the proportions of vinyl acetate and methyl acrylate to use in the EVA and EMA, respectively. Moreover, the piccopale and amorphous polypropylene are used to improve the bonding of the ethylene/vinyl acetate elastomer 302*b* with the primary backing 302*a* and the pile yarn fiber.

In order to lessen the cost, or to otherwise modify elastomer 302*b*, different types of fillers may be added to elastomer 302*b*. Such filler is usually less expensive than the thermoplastic used for elastomer 302*b*, yet does not significantly reduce the effectiveness of elastomer 302*b*. An example of filler which may be mixed with elastomer 302*b* is aluminum hydrate, or clay, available from the Huber Company, Clay Division, of Macon, Ga., and sold under the brand name of Huber 95 or KAOLIN (trademarks of Huber).

In one embodiment, where EVA is used as elastomer 302*b* and wherein the EVA is normally applied to primary backing 302*a* so that the EVA has a weight of 5—20 ounces/yard$^2$, filler may be added to the EVA before it is applied to primary backing 302*a* so that the resulting thermoplastic/filler mixture has a weight of 8–28 ounces/yard$^2$. Adding the filler may thus serve to add stiffness to the tufting backing 302.

In addition to filler, elastomer 302*b* may also be foamed in order to reduce the stiffness of the carpet, to expand the volume of elastomer 302*b*, and/or to lessen the weight. Foaming agents such as azodiacarbonamide, available from Uniroyal Chemical, under the brand name "Celogen" (a trademark of Uniroyal), may be used for this purpose. Of course other equivalent fillers and foaming agents may be used as well. In a preferred embodiment, tufting backing may be made with elastomer 302*b* to which filler has been added, but to which foam has not been added.

Figure 4A:
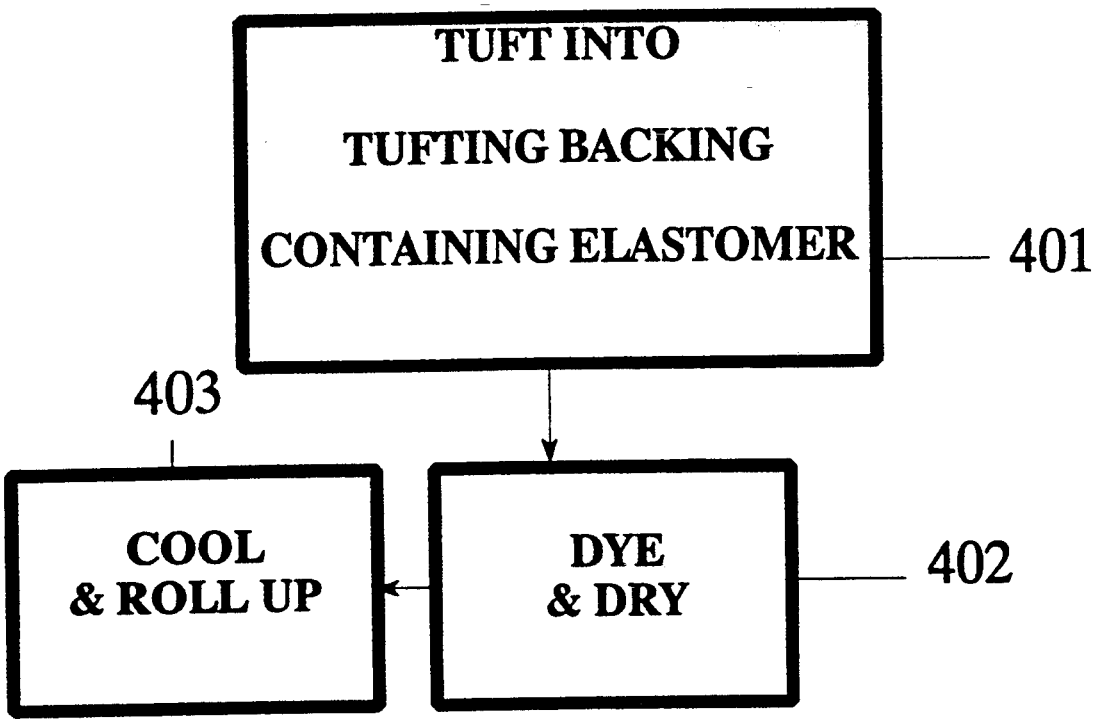
FIG. 4A depicts a process diagram for making the tufted carpet depicted in FIGS. 3A or 3B, according to a preferred embodiment of the present invention.

Referring to FIG. 4A, a process diagram is shown which depicts the various general steps which may be taken in order to make the tufted carpet shown in FIG. 3A. In step 401, one or more pile yarn fibers (reference numeral. 301 in FIG. 3A) are tufted through a tufting backing (reference numeral 302 in FIG. 3A). As described above with respect to FIG. 3A., tufting backing 302 comprises a primary backing 302*a*, a secondary backing 302*c*, and an elastomer 302*b*. Alternatively, as shown in FIG. 3B, tufting backing may comprise primary backing 302*a* and elastomer 302*b*, without secondary backing 302*c*. The elastomer 302*b* is preferably a thermoplastic, such as ethylene/vinyl acetate, although other suitable materials could be used as well.

In step 401, the tufting of pile yarn fibers 301 may be accomplished by a method which is commonly known to those of ordinary skill in the art. In a preferred embodiment, pile yarn fibers 301 may be tufted by using tufting equipment available from Card Monroe Corporation, such as model number HST-420. It will be readily understood that there are numerous methods of tufting pile yarn fibers 301, and the present invention should not be construed to be limited to any one method.

After the pile yarn fibers 301 are tufted into tufting backing 302, in step 402 the carpet, and thus the pile yarn fibers 301, may be dyed to a specified color, and thereafter dried by applying heat. In addition to drying the previously dyed carpet, the heat also causes the elastomer (thermoplastic) 302*b* on the tufting backing 302 to soften around the pile yarn fibers 301. The softened thermoplastic 302*b* is therefore able to flow in and around pile yarn fibers 301.

The particular temperature to which tufting backing 302 is heated is dependent upon the particular dye utilized, as well as the characteristics of the thermoplastic 302*b* utilized. That is, the tufting backing 302 should be heated to just above the initial melting point of the thermoplastic 302*b*, but not too high so as to damage the tufting backing or the pile yarn fibers 301.

After tufting backing 302 is heated and thermoplastic 302*b* softens, tufting backing 302 may be cooled and rolled in step 403. In a preferred embodiment, tufting backing 302 may be cooled by exposing it to ambient room temperature. Importantly, cooling step 403 need not comprise a separate cooling step in the present invention, but may instead be performed implicitly by exposure to the surrounding environment.

Cooling the tufting backing 302 causes elastomer (thermoplastic) 302*b* to cool and solidify, which causes thermoplastic 302 to bond to pile yarn fiber 301. The pile yarn fibers 301 are thus bonded into place by thermoplastic 302*b*.

Figure 4B:
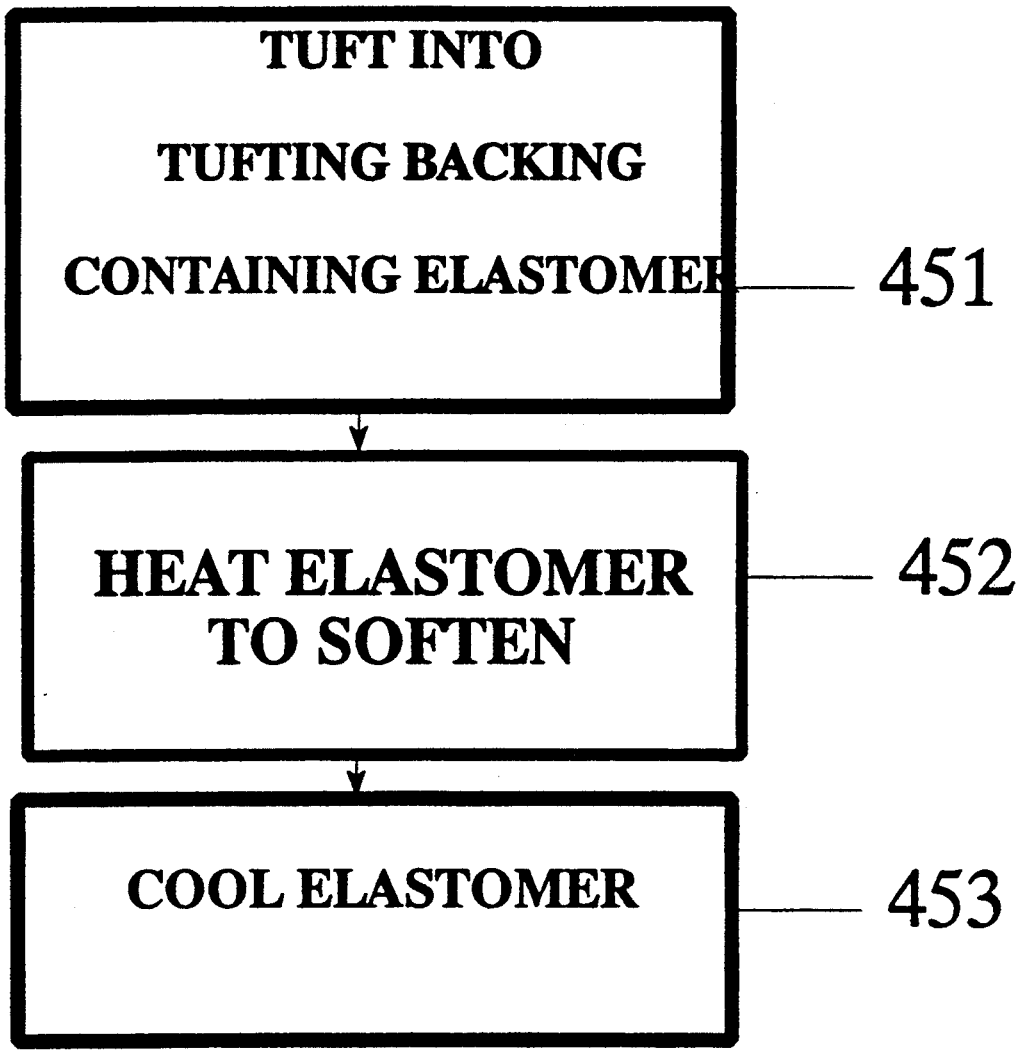
FIG. 4B depicts a process diagram for making the tufted carpet depicted in FIGS. 3A or 3B, according to another embodiment of the present invention.

FIG. 4B depicts an alternate methodology for tufting and bonding pile yarn fibers 301 onto tufting backing 302. Particularly, step 451 corresponds to step 401 of FIG. 4A, where pile yarn fibers 301 are tufted into tufting backing 302. However, if pile yarn fibers 301 are predyed, then step 402 in FIG. 4A need not be performed. Instead, step 452 of FIG. 4B is performed, whereby the elastomer 302*b* is heated to a softening point (thus allowing elastomer 302*b* to flow in and around pile yarn fibers 301). Step 452 may be accomplished by heating the elastomer 302*b* in an oven or an equivalent heating means. Since the pile yarn fibers 301 are not dyed, the heating time for this step can be 30% to 50% faster because the pile yarn fibers 301 do not need to be dried. Moreover, the heating time for this step may be an even greater percent faster when compared to drying frothy latex as described for prior art carpet.

In step 453, the elastomer is cooled, for example, to room temperature or another specified temperature, to allow pile yarn fibers 301 to bond to elastomer 302*b*. Once again, cooling step 453 need not comprise a separate step in the present invention, but may instead be performed implicitly by exposure to the surrounding environment.

The process described above with respect to FIGS. 4A and 4B, as well as the tufted carpet shown in FIGS. 3A and 3B, has numerous advantages over the carpet described in FIGS. 1 and 2. First, because tufting backing 302 is used instead of separate primary backing 102, latex 103 and secondary backing 104 (as shown in prior art FIG. 1), the present invention requires that fewer different types of material need be inventoried and assembled during the manufacturing stage of the carpet. Rather, the tufting backing 302 of the present invention may be more efficiently made part of the carpet. This results in less equipment necessary for the manufacturing of the carpet, less complex equipment, faster manufacturing time, less necessary manufacturing space, less inventory, and a resulting cost savings.

Additionally, because thermoplastic 302*b* is melted in and around pile yarn fibers 301, and thereafter bonds to pile yarn fibers 301 when cooled, a greater bonding of pile yarn fibers 301 is achieved when compared to merely coating latex to the pile yarn fibers 301, so that pile yarn fibers 301 may not be easily pulled out of the tufting backing 302.

Another advantage found in the tufted carpet of the present invention is the elimination of the roughness found in carpets using the application of latex (reference numeral 103 in FIG. 1) and calcium carbonate after the pile yarn fibers 101 are tufted into the primary backing. Although a secondary backing 104 may be applied to those carpets, the general roughness of the back of those carpets makes installation of the carpet difficult in certain situations. This roughness is not found in the tufted carpet of the present invention, as the back of the pile yarn fibers 301 make a smoother and more attractive surface on the back of the carpet.

The above-described advantages over the prior known processes and apparatuses are included for example purposes only. The present invention includes many other advantages over the prior art, as will be readily understood by one of ordinary skill in the art.

What has been described is a preferred embodiment of the present invention. It will be readily understood by the skilled artisan that many variations of the present invention are possible, and that many components described above have equivalents. For example, the teachings of the present invention could be applied to materials or fabrics other than carpet. All such possible variations are to be included within the scope of the claimed invention, as defined by the appended claims below.

I claim:

1. A tufting backing adapted for tufting pile yarn fibers therethrough, said tufting backing comprising:

(a) a primary backing; and (b) an elastomer affixed to a first side of said primary backing, wherein said elastomer is affixed to said primary backing in non-contiguous portions which create at least one void on said first side of said primary backing.

2. The tufting backing of claim 1, wherein said at least one void on said first side of said primary backing is created by affixing said elastomer to said primary backing in non-contiguous portions having shapes selected from the group consisting of:

(1) a strand;

(2) a dash; and (3) a dot.

3. The tufting backing of claim 1, wherein said elastomer is affixed to said first side of said primary backing according to the following steps:

(i) heating said elastomer to a first specified temperature, whereby said elastomer melts; and (ii) pumping said elastomer on to said first side of said primary backing.

4. The tufting backing of claim 3, further comprising the following step:

(iii) cooling said elastomer at a second specified temperature, wherein said elastomer hardens.

5. The tufting backing of claim 1, wherein said elastomer comprises a low viscosity.

6. The tufting backing of claim 3, wherein step (i) further comprises treating said top side of said primary backing for accepting said elastomer prior to said pumping step.

7. The tufting backing of claim 6, wherein said first side of said primary backing is treated with a corona discharge in step (i).

8. The tufting backing of claim 6, wherein said first side of said primary backing is treated with a gas flame in step (i).

9. The tufting backing of claim 3, wherein said elastomer is pumped on to said primary backing in step (ii) through at least one orifice in a die.

10. The tufting backing of claim 4, wherein said elastomer is cooled with at least one chilled roller in step (iii).

11. The tufting backing of claim 3, further comprising the step of applying lubricant to said primary backing subsequent to step (ii).

12. The tufting backing of claim 11, wherein said lubricant is applied to a second side of said primary backing.

13. The tufting backing of claim 3, further comprising the step of suctioning said elastomer to said primary backing.

14. The tufting backing of claim 13, wherein said elastomer is suctioned to said primary backing with a vacuum.

15. The tufting back of claim 1, wherein said primary backing comprises a material selected from the group consisting of a woven polypropylene sheet, a non-woven polypropylene sheet and a jute sheet.

16. The tufting back of claim 1, wherein said elastomer comprises a thermoplastic material.

17. The tufting back of claim 16, wherein said thermoplastic material is selected from the group consisting of ethylene/vinyl acetate, ethylene/methyl acrylate and ethylene/ethyl acetate.

18. The tufting back of claim 1, wherein said elastomer material comprises a filler.

19. The tufting back of claim 18, wherein said filler is selected from the group consisting of aluminum hydrate and clay.

20. The tufting back of claim 1, wherein said elastomer comprises a foam.

21. The tufting back of claim 20, where said foam is azodiacarbonamide.

22. The tufting back of claim 1, wherein said non-contiguous portions of elastomer comprise a geometric shape.

23. The tufting back of claim 22, where said geometric shape is selected from the group consisting of a square, a rectangle, a triangle and a circle.

* * * * *